US005396574A

United States Patent [19]

Base et al.

[11] Patent Number: 5,396,574

[45] Date of Patent: Mar. 7, 1995

[54] TUBULAR HIGH EFFICIENCY, NON-CONTAMINATING FLUID HEATER

[75] Inventors: Howard J. Base, Macedonia; Richard A. Lokar, Orwell; Dennis J. Rezabek, Thompson, all of Ohio

[73] Assignee: Process Technology, Inc., Mentor, Ohio

[21] Appl. No.: 857,753

[22] Filed: Mar. 26, 1992

[51] Int. Cl.[6] ..... F24H 1/10; H05B 3/82

[52] U.S. Cl. ..... 392/489; 219/523; 392/503

[58] Field of Search ..... 392/478–496, 392/503; 219/523

[56] References Cited

U.S. PATENT DOCUMENTS

| | | | |
|---|---|---|---|
| 1,505,179 | 8/1924 | Whiteley | 392/489 X |
| 1,759,774 | 5/1930 | Andriulli | 392/489 |
| 2,809,268 | 10/1957 | Heron . | |
| 2,879,372 | 3/1959 | Dammond | 392/489 |
| 3,125,657 | 3/1964 | Colten . | |
| 3,870,033 | 3/1975 | Faylor et al. | 392/496 X |
| 3,968,346 | 7/1976 | Cooksley . | |
| 4,085,308 | 4/1978 | Youngquist | 392/489 X |
| 4,179,603 | 12/1979 | Zeigler et al. . | |
| 4,371,777 | 2/1983 | Roller et al. . | |
| 4,423,311 | 12/1983 | Varney | 392/489 X |
| 4,461,347 | 7/1984 | Layton et al. | 392/487 |
| 4,567,350 | 1/1986 | Todd | 392/489 X |
| 4,762,980 | 8/1988 | Insley . | |
| 4,835,365 | 5/1989 | Etheridge | 392/489 |
| 5,054,107 | 10/1991 | Batchelder | 392/483 |
| 5,054,108 | 10/1991 | Gustin et al. | 392/492 |

FOREIGN PATENT DOCUMENTS

| | | | |
|---|---|---|---|
| 161709 | 3/1955 | Australia | 392/488 |
| 261481 | 4/1960 | Australia | 392/489 |
| 236937 | 1/1962 | Australia | 392/489 |
| 75274 | 3/1983 | European Pat. Off. | 392/489 |
| 2853910 | 7/1980 | Germany | 392/489 |
| 3432717 | 3/1986 | Germany | 392/488 |
| 166706 | 3/1934 | Switzerland | 392/489 |
| 527759 | 10/1940 | United Kingdom | 392/488 |
| 2100559 | 12/1982 | United Kingdom | 392/489 |
| 2224103 | 4/1990 | United Kingdom | 392/489 |

OTHER PUBLICATIONS

"Requirements For Ultrapure Water" by Takaai Fukumoto, Ultraclean Technology Handbook, vol. 1 published by Marcel Dekker Inc. 1993, pp. 3, 28–30 and 42–46.

*Primary Examiner*—Anthony Bartis

[57] ABSTRACT

A tubular high efficiency, non-contaminating fluid heater includes an elongate tubular member having a coil-like configuration and a sidewall which defines an elongate tubular chamber formed from an inert material through which fluid is adapted to flow. The tubular member includes an inlet and an outlet and a plurality of elongate electrical resistance heaters sheathed with the same inert material are disposed in said tubular chamber for heating the fluid as it flows through the tubular chamber. Each of the resistance heaters has a coil-like configuration which extends through the tubular chamber and a heater end portion at each end thereof which has an arcuate generally streamlined configuration substantially parallel to the directions of fluid flow which extends through the sidewalls of the tubular member to substantially eliminate interstitial matrices in the fluid flow adjacent the ends of the elongate electrical resistance heaters which extend through the sidewalls of the tubular member and wherein a high velocity fluid turbulent fluid flow having a Reynold's number greater than 4000 is established through the tubular chamber.

14 Claims, 2 Drawing Sheets

TUBULAR HIGH EFFICIENCY, NON-CONTAMINATING FLUID HEATER

DESCRIPTION—TECHNICAL FIELD

The present invention relates to a tubular high efficiency, non-contaminating fluid heater which minimizes fluid pressure drop therethrough and which minimizes fluid interstitial matrices which provide potential contamination sites. The heater assembly is particularly adapted to heat fluids in ultrapure applications such as for use in the semiconductor industry.

BACKGROUND OF THE INVENTION

Heater assemblies for use in ultrapure applications are known in the art. Generally, ultrapure fluids contain some particulates such as dirt, ion exchange resin, and dead bacteria and virus. Typical quantities of such contaminates are 10 to 100 particles per liter of fluid. It is undesirable to allow these contaminates to accumulate. Many of the known heater assemblies include stagnant zones and fluid interstitial matrices that provide potential contamination sites. A fluid velocity drop occurs at the stagnant zones and the stagnant zones tend to accumulate contaminates and/or particulates from the fluid to be heated which are then reintroduced into the fluid flow as slugs of material. When contaminates accumulate in stagnant zones, the geometry of the zones change as particulates and other contaminates accumulate. The change in geometry causes a fluid velocity drop which furthers the accumulation of contaminates. These contaminates can then break loose and travel through the fluid heater to contaminate the fluid and the items such 05 as semiconductor wafers washed by the fluid. Such a construction is not desirable in ultrapure applications such as used in the semiconductor industry where potential contamination of products is unacceptable. For example, known heat exchangers such as disclosed in Dammond, U.S. Pat. No. 2,879,372, or Heron, U.S. Pat. No. 2,809,268, provide non-streamlined tubular flow paths which include tees, recesses and chambers where the element exits which create stagnant zones in the fluid flow that provide potential contamination sites and hence are not well suited for heating fluid in ultrapure applications. Contaminate sites caused by interstitial matrices consist of multiple random surfaces which accumulate contaminates. These random surfaces effect a fluid velocity drop with a resultant increase in the potential for particulate deposition at these site. Tests conducted comparing the cleanliness of the outputted heated fluid from a heater constructed in accordance with the present invention and from conventional, commercially available heaters show a significant improvement in outputted fluid cleanliness when a heater constructed in accord and with the present invention is utilized.

SUMMARY OF THE INVENTION

The present invention provides a new and improved non-contaminating fluid heater for use in ultrapure applications which minimizes fluid pressure drop therethrough and which minimizes fluid interstitial matrices therein which provide potential contamination accumulation sites.

A provision of the present invention is to provide a tubular high efficiency, non-contaminating fluid heater which includes an elongate tubular member defining a tubular chamber having a plurality of elongate electrical resistance heaters located therein for heating fluid as it passes through the tubular chamber and wherein the electrical resistance heaters include arcuate heater end portions which have a streamlined generally arcuate configuration which extends through the sidewalls of the tubular member to substantially eliminate interstitial matrices and stagnant zones in the fluid flow adjacent the termination means of the elongate resistance heaters.

A further provision of the present invention is to provide a tubular high efficiency non-contaminating fluid heater which includes an elongate tubular member having a coil-like configuration and a substantially cylindrical sidewall which defines an elongate tubular chamber through which fluid is adapted to flow and a plurality of elongate electrical resistance heaters located in the tubular chamber and each of which includes an arcuate heater end portions at one end thereof having a streamlined generally arcuate configuration which extends through the sidewalls of the tubular member. The streamlined generally arcuate configuration of the arcuate heater end portions substantially eliminates interstitial matrices in the fluid flow adjacent the ends of the elongate electrical resistance heaters which extend through the sidewall of the tubular member.

Another provision of the present invention is to provide a new and improved tubular high efficiency heater as set forth in the preceding paragraph, further including a flow switch for sensing fluid flow through the tubular heater, the flow switch being adapted to energize the electrical resistance heaters in response to fluid flow through the tubular chamber.

Still another provision of the present invention is to provide a tubular high efficiency, non-contaminating fluid heater as set forth in the preceding paragraph, further including an exhaust valve in fluid communication with the tubular chamber for bleeding fluid from the tubular chamber for a predetermined period of time in response to termination of fluid flow through the tubular chamber.

DESCRIPTION OF THE PREFERRED EMBODIMENT

Figure 2:
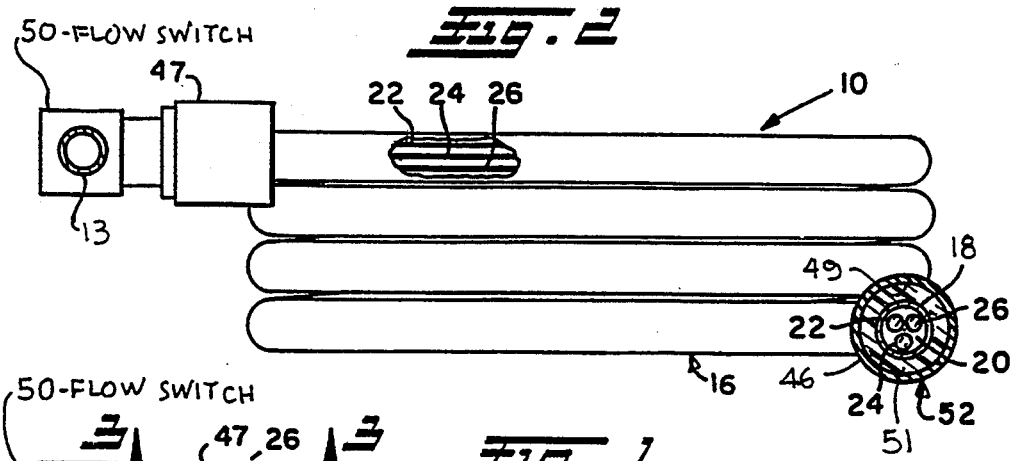
FIG. 2 is a side view taken approximately along the lines 2—2 of FIG. 1 more fully illustrating the tubular high efficiency, non-contaminating fluid heater.
Figure 1:
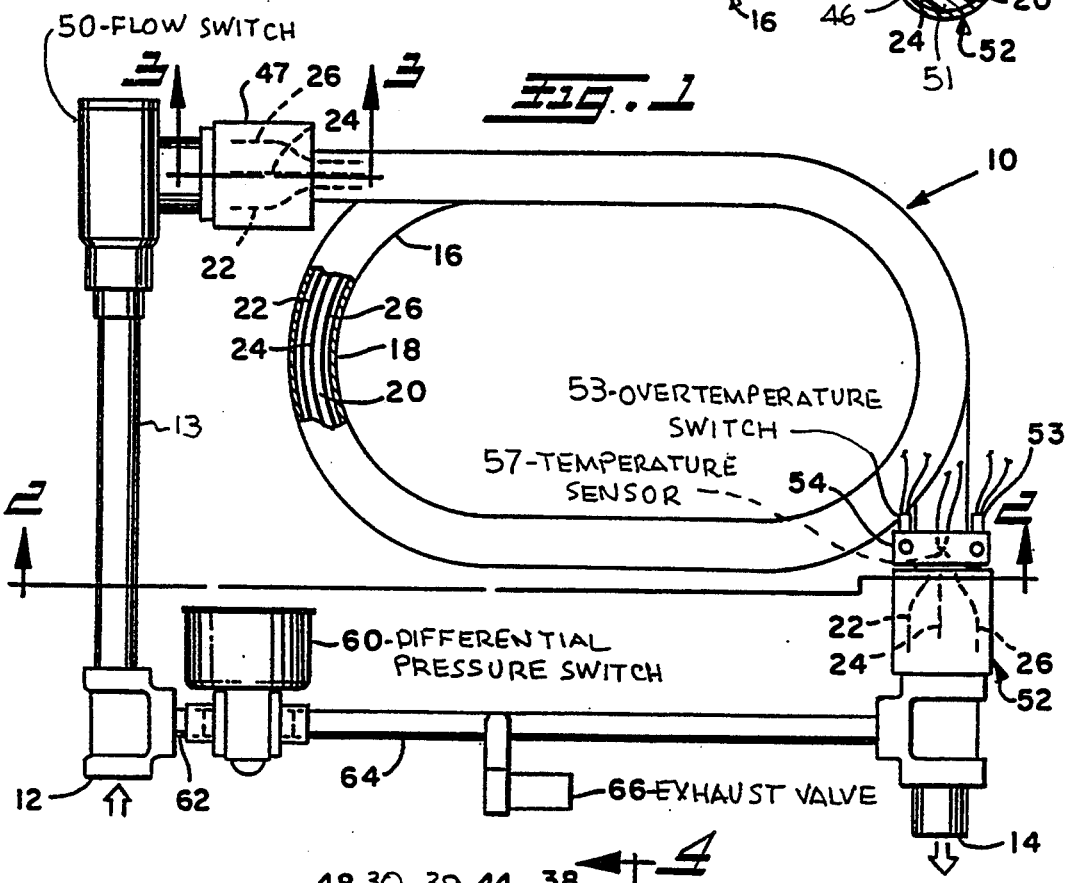
FIG. 1 is a top view of the tubular high efficiency, non-contaminating fluid heater of the present invention.

Referring to the figures, and more particularly, to FIGS. 1 and 2, a tubular high efficiency, non-contaminating fluid heater 10 is disclosed. The heater 10 includes a elongate tubular member 16 which generally has a coil-like or serpentine configuration which enhances the turbulent fluid flow through the heater 10 and which provides a compact heater assembly. The tubular member 16 includes a sidewall 18 which defines an elongate tubular chamber 20 through which fluid (gas or liquid) is adapted to flow to be heated. The heater assembly 10 includes an inlet 12 into which fluid to be heated is directed and an outlet 14 through which the heated fluid flows from the heater 10. A pipe 13 joins intent 12 and flow switch 50.

A plurality of elongate mental sheathed electrical resistance heaters 22, 24 and 26 extend through the tubular chamber 20 in the tubular member 16 to effect heating of the fluid flowing through the elongate tubular chamber 20. The elongate electrical resistance heaters 22, 24 and 26 extend through the tubular chamber 20 substantially coaxial with the tubular chamber 20 and are adapted to come into intimate contact with the fluid flow through the chamber 20 to effect rapid and efficient heating of the fluid when the electrical resistance heaters 22, 24 and 26 are energized. The length of the tubular chamber 20 and the length of the electrical resistance heaters 22, 24 and 26 is chosen to suit the power and heating requirements of the heater 10.

Figure 3:
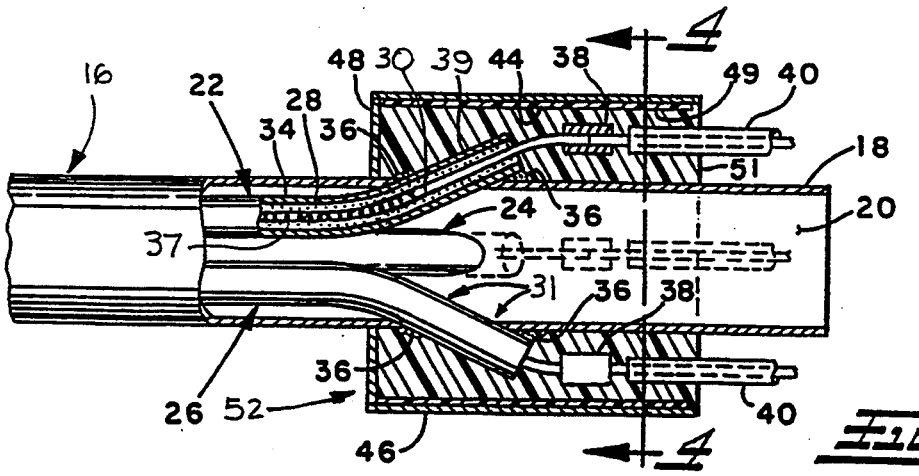
FIG. 3 is an enlarged cross-sectional view taken approximately along the lines 3—3 of FIG. 1, more fully illustrating the arcuate heater end portions at the ends of the electrical resistance heaters.

Each of the electrical resistance heaters 22, 24 and 26, which are commercially available resistance heaters, as is more fully illustrated in FIG. 3, includes a coiled electrical resistance element 28 disposed within an inert metallic sheath 34 which in the preferred embodiment comprises stainless steel or titanium sheathing. The heater material contributes ions to the fluid as the fluid passes therethrough and it is desirable to use a substantially inert material to minimize ion contamination. A stainless steel sheath 34 can be used with many applications but in ultrapure applications, such as used in the semiconductor industry, a titanium sheath 34 is desirable due to its increased inertness as compared to stainless steel. The tubular member 16 is constructed of either stainless steel or titanium and the material is chosen to match the material from which the sheath 34 is constructed to provide the same inertness.

A termination means comprising a cold pin 30 is connected to each of the electrical resistance elements 28 to direct power from a suitable power source, not illustrated, to affect energization of the electrical resistance element 28. Magnesium oxide 37 is disposed between the resistance element 28 and the cold pin 30 and the sheath 34 of the heaters 22, 24 and 26. As is well known, when a suitable source of energy is directed through the cold pin 30 to the electrical resistance element 28, the element 28 generates heat which is conducted through the magnesium oxide 37 to the sheath 34 to effect heating of the fluid flowing through the chamber 20 which is in intimate contact with the heated sheath 34. An arcuate portion 31 at each end of each of the electrical resistance heaters 22, 24 and 26 extends through a sealed opening in the sidewall 18 of the tubular member 16 to provide for connection of a suitable power source to the electrical resistance heaters 22, 24, 26 exteriorly of the tubular chamber 20. If the connection of the power supply to the resistance heaters 22, 24 and 26 was within the tubular chamber, the bulk of the connection could cause stagnant zones and/or interstitial matrices which could collect particulates as fluid flows around the connection. Accordingly, the termination and connections to the power source occur outside tubular chamber 20.

Figure 4:
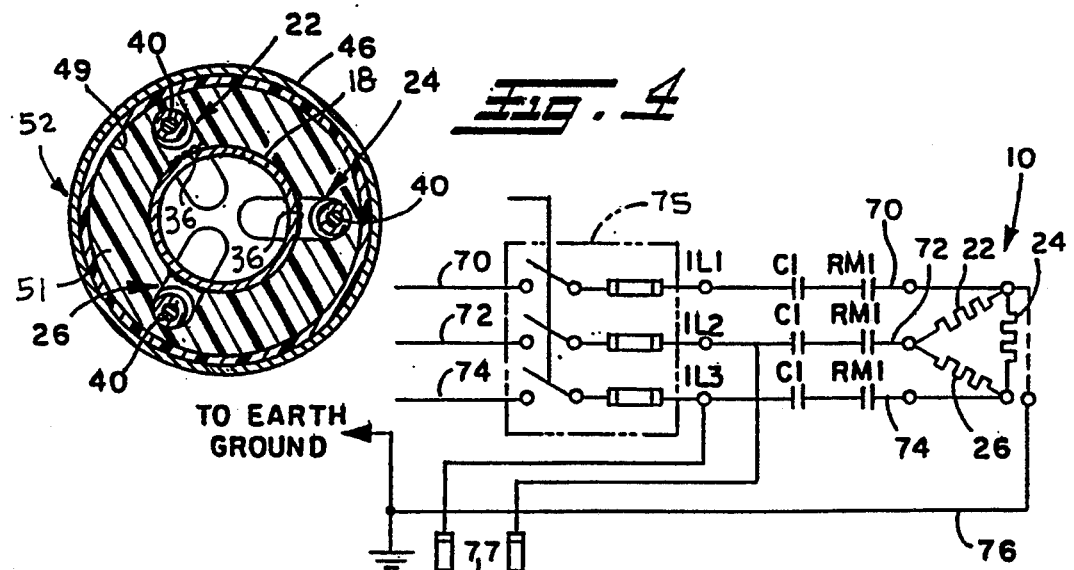
FIG. 4 is an enlarged crossectional view taken approximately along the lines 4—4 of FIG. 3, more fully illustrating the arcuate heater end portions at the ends of the electrical resistance heaters.

As illustrated in FIGS. 3 and 4, each of the heater end portions 31 has a streamlined arcuate configuration substantially parallel to the direction of the fluid flow which passes through the sidewall 18 of the tubular member 16. A suitable sealing operation, such as welding illustrated at 36, can be utilized to seal the opening through which the arcuate heater end portions 31 extends through the sidewall 18. When a welding operation at 36 is performed to seal the where the arcuate heater end portions 31 pass through the sidewall 18, it is desirable to remove some of the magnesium oxide from the arcuate heater end portions 31 adjacent the weld 36 to prevent the heat from the welding operation from degrading the magnesium oxide and allowing moisture to enter the arcuate heater end portions. Accordingly, the magnesium oxide adjacent the weld 36 is removed by a hollow tube-shaped cutter prior to welding from the end of arcuate heater end portion 31 to approximately one-quarter to one-half inch beyond the intended weld zone. This eliminates degradation of the magnesium oxide from the high temperatures associated with welding. After welding, the heater 10 is baked at a high temperature to remove any absorbed moisture from the resistance heaters 22, 24 and 26. The cavity created by the removal of magnesium oxide is then filled with a high temperature epoxy 39 to seal the arcuate heater end portions 31 and to prevent moisture from entering the interior of the heaters 22, 24, and 26.

The arcuate configuration of the heater end portions 31 at the sidewall 18 minimizes interstitial matrices adjacent the heater elements where the arcuate heater portion 31 extends through the sidewall 18. Such a construction eliminates heater elements and termination means which are disposed substantially perpendicular to the direction of fluid flow and allows use in ultrapure applications such as in the semiconductor industry. A suitable connector 38 is provided adjacent the end of each of the cold pins 30 and is adapted to receive an insulated power conductor 40 therein for directing power through the electrical resistance heaters 22, 24 and 26.

The electrical resistance heaters 22, 24 and 26 extend through the tubular chamber 20 substantially coaxial to the axis of the tubular chamber 20. The resistance heaters 22, 24 and 26 provide a restricted flow area within the tubular chamber 20 between the exterior of the resistance heaters 22, 24 and 26 and the sidewall 18. The net cross-sectional area within chamber 20 is such that fluid being heated has a turbulent flow having a Reynolds number greater than 4,000. This causes fluid flowing around the electrical resistance heaters 22, 24 and 26 in chamber 20 to have a turbulent flow path as it flows in intimate contact with the electric heaters. This permits higher operating watt densities and subsequently higher fluid differential temperatures, allowing the heater assembly 10 to have a high efficiency. The use of arcuate portions 31 at the ends of the electrical resistance heaters 22, 24 and 26 minimizes fluid pressure drop as fluid flows past the termination of the heater elements and minimizes fluid interstitial matrices and stagnant zones that could provide contamination sites. The reduced fluid pressure drop allows the use of higher fluid velocities and provides for an intimate and rapid flow of the heated fluid about the electrical resistance heaters 22, 24 and 26.

A sealed chamber 44 is provided for sealing the connection of the cold pins 30 and the power conductor 40 exteriorly of the tubular chamber 20. The sealed chamber 44 is defined in part by a cylindrical member 46 having an annular end wall 48 which extends from the cylindrical member 46 to the outer surface of the cylindrical sidewall 18 of the tubular member 16. The end wall 48 is suitably attached and sealed to the sidewall 18 and to the cylindrical member 46 to effectively provide a chamber 44. A non-conductive, preferably Teflon insulating layer 49 is disposed on an interior surface defining the chamber 44 to prevent short circuit currents from passing from the cold pins 30, connector 38 or power conductor 40 to the exterior of the heater assembly 10 via the cylindrical member 46. The use of Teflon insulating material 49 minimizes the potential for short circuits exiting the chamber 44 due to the close proximity of the cold pins 30 to the member 46.

The chamber 44 is preferably filled and sealed with an epoxy potting compound 51 after the electrical conductors 40 are connected to the termination means or cold pin 30 of each of the electrical resistance heaters 22, 24 and 26 to protect and hermetically seal the connector 38. Moisture destroys the heaters and cold pins 30 and the epoxy potting compound seals the heater ends 31 against moisture. In the preferred embodiment of the invention, a sealed chamber 44 is provided at each end of the plurality of electrical resistance heaters 22, 24, 26. Thus, a housing 47 is disposed at the inlet end 12 of the tubular member 16, as illustrated in FIG. 1, and an identical housing 52 having a sealed chamber 44 therein is disposed adjacent the outlet end 14 of the tubular member 16.

Figure 5:
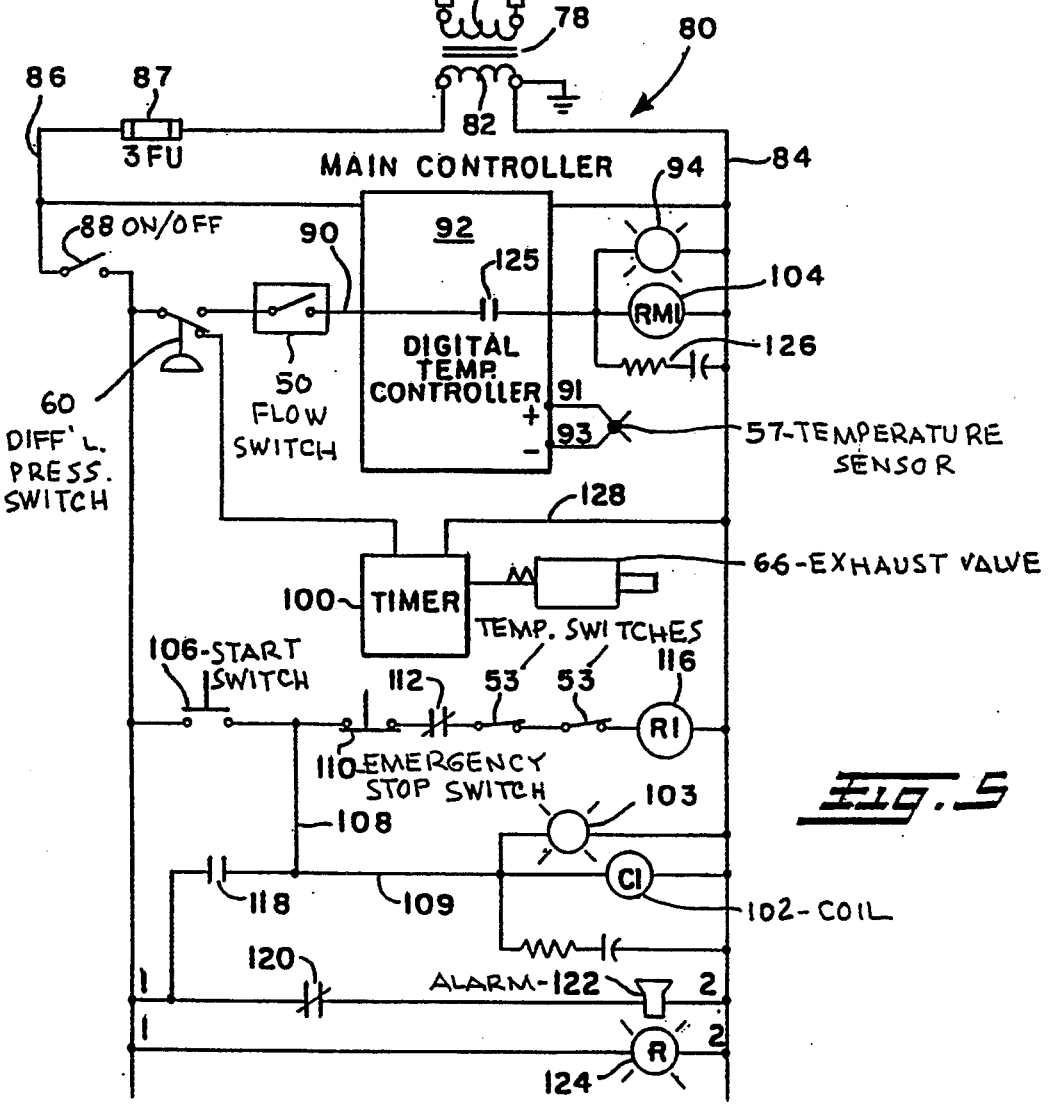
FIG. 5 is a schematic diagram of the control for the high efficiency, non-contaminating fluid heater.

An earth ground conductor 76, schematically illustrated in FIG. 5, is preferably connected to the heater 10 to ground the tubular member 16 and the heater 10 to prevent stray currents from injuring personnel in contact with the heater assembly 10.

A flow switch 50 is associated with the inlet end of the tubular member 16. The flow switch 50 is adapted to sense fluid flow through the tubular member 16 and effect, in conjunction with a differential pressure switch 60, energization of the electrical resistance heaters 22, 24 and 26 in response to sensing fluid flow. In addition, the flow switch 50 is also adapted to sense the volume of fluid flow and denergize the electrical resistance heaters 22, 24 and 26 in the event that the fluid flow through the tubular member 16 is not above a predetermined level and/or if fluid flow ceases. It is undesirable to energize the electrical resistance heaters when there is not an adequate flow of fluid through the tubular member 16. If the level of fluid flow is not above a predetermined volume, the fluid flow will not be turbulent and the fluid will be heated to a temperature in excess of the desired temperature. Accordingly, the flow switch 50 operates to denergize the electrical resistance heaters 22, 24, 26 in the event that the fluid flow in the tubular chamber 20 is not above a predetermined level and in the event that the fluid flow ceases.

A pair of over-temperature responsive switches 53 are located adjacent to the outlet 14 of the tubular member 16. A heat sink 54 can be attached to the tubular member 16 adjacent the outlet 14 to support the temperature sensor 57 and the temperature responsive switches 53 to be responsive to the temperature of the fluid passing from outlet 14. The over-temperature switches 53 are series connected and each switch 53 is adapted to sense the temperature of the fluid exiting the heater 10 and effect de-energization of the electrical resistance heaters 22, 24 and 26 in the event that the temperature of the fluid exiting the tubular member 16 is above a predetermined temperature, as sensed by at least one of the sensors 53. The temperature sensor 57 in conjunction with the control 92 and/or switches 53 cooperate with the flow switch 50 to provide safety control and fail safe operation of the heater assembly 10. As indicated above, the heater 10 is not energized unless the flow through the tubular chamber 20 is above a predetermined volume and the temperature responsive switches 53 or sensor 57 in conjunction with control 92 is adapted to denergize the electrical resistance heaters in the event that the temperature of the fluid exiting the tubular chamber 20 is above a predetermined temperature.

A differential pressure switch 60 is provided to sense the differential pressure created by the flow of fluid through the heater between the inlet 12 and the outlet 14 of the tubular member 16. A conduit 62 connects the differential pressure switch 60 with the inlet 12 and a conduit 64 connects the differential pressure switch 60 to the outlet 14. Conduit 62 transmits to differential pressure switch 60 a pressure indicative of the pressure at the inlet 12 and conduit 64 transmits to the differential pressure switch 60 a pressure indicative of the pressure in the outlet 14. If a differential pressure of a predetermined magnitude is present, differential pressure switch 60 will close.

A solenoid operated normally closed exhaust valve 66 is disposed in line 64 and is adapted to be responsive to the differential pressure switch 60 and the flow swich 50. When the flow switch 50 and/or differential pressure switch 60 senses the absence of an adequate fluid flow through the tubular chamber 20, the differential pressure switch 60 will affect actuation of the normally closed solenoid operated exhaust valve 66 to vent the tubular chamber 20 to atmosphere or a suitable drain connection for a predetermined time period. This allows the fluid disposed within the tubular chamber 20, when fluid flow through the heater 10 ceases, to be vented from the tubular chamber 20 to remove residual heat, thus preventing the residual heat in the electrical resistance heaters 22, 24 and 26 from overheating any fluid remaining in the chamber 20. If the fluid was overheated, residues and contaminates could be left in chamber 20. A timer 100, more fully described below, energizes and holds open valve 66 for a predetermined fixed time period to insure that the residual heat in the electrical resistance heaters 22, 24 and 26 has been removed.

A schematic control diagram for controlling the heater 10 of the present invention is more fully disclosed in FIG. 5. A power supply, preferably a three phase power supply, including power conductors 70, 72 and 74 is provided to effect energization and control of the electrical resistance heaters 22, 24 and 26. The lines 70, 72 and 74 pass through a fused power disconnect 75 or circuit breaker to energize the electrical resistance heaters 22, 24 and 26. A pair of normally open contacts C1 and RM1 are provided in each of the lines 70, 72 and 74 between the disconnect 75 and the electrical resistance heaters. The contacts RM1 in each of the lines 70, 72 and 74 are normally open main contacts associated with heating contactor 104 for energizing each of the heaters 22, 24, 26 and the normally open contacts C1 in each of the lines 70, 74 and 77 are associated with a safety relay 102 to be more fully described hereinbelow. A ground 76 is provided adjacent to the heaters 22, 24 and 26 to conduct any stray currents in the heater assembly 10 or control circuit 80 to a suitable earth ground.

A fused step down transformer 78, having its primary 77 connected across the lines 72 and 74, is provided to energize a control circuit 80. The secondary 82 of transformer 78 energizes the power busses 84 and 86 of the control circuit 80. The buss is fused at 87 for short circuit protection.

A main power switch 88 is provided for energizing the control circuit 80. When the main power switch 88 is closed, the power busses 84 and 86 are energized and an indicator light 124 connected across busses 84 and 86 is energized. The main power switch 88 is connected to buss 86 and to normally open differential pressure switch 60 which is in turn series connected with the normally open flow switch 50. The output of flow switch 50 is connected to an input 90 of a digital temperature controller 92 for energizing the heating contactor 104 to close contacts RM1 in each of the lines 70, 72 and 74. When fluid flow above a predetermined volume is present in the tubular chamber 20, pressure switch 60 closes and flow switch 50 closes to apply a potential at terminal 90 of digital temperature control 92. In the preferred embodiment, the control 92 can be a digital temperature controller such as a model DML sold by Process Technology, Inc., Mentor, Ohio. Energization of terminal 90 of the control 92 affects energization of a heating contactor 104 and closing of the control contacts RM1 in lines 70, 72 and 74 when the temperature sensor 57, which in the preferred embodiment consists of a thermocouple device which is connected at 91 and 93 to the digital temperature controller 92, detects that the temperature in the fluid in heater 10 is below the preset temperature entered into control 92 and closes contacts 125. A surge suppressor 126, consisting of a resistor and capacitor, is provided to reduce the electromagnetic surges created when heating contactor 104 is energized or denergized. An indicator light 94 is energized upon energization of the heating contactor 104.

When the heating contactor 104 is energized and contacts RM1 close, the electrical resistance heaters 22, 24 and 26 are not energized as a result of the normally open contacts C1 in lines 70, 72 and 74. In order to close each of the safety contacts C1, a safety start button 106 must be manually depressed subsequent to closing of power switch 88. The safety start button 106 is connected via lines 108 and 109 to the safety relay 102. When the safety start button 106 is manually depressed, the safety relay 102 will be connected across energized power busses 84 and 86 and relay 102 will be energized by relay 116 normally open contacts 118 which close, to close contactors C1 to effect energization of the electrical resistance heaters 22, 24 and 26.

The safety start button 106 is series connected with an emergency stop button 110, alarm contacts 112, a pair of series connected temperature sensitive switches 53, and relay coil 116. When the safety start button 106 is manually depressed, relay 116 will be energized. Normally open power contacts 118 and normally closed power contacts 120 are associated with the relay 116. When the relay 116 is energized, the normally open contacts 118 will close to provide a holding circuit which energizes safety relay 102 and the light 103 and normally closed contacts 120 will be opened. An audible alarm such as illustrated at 122 is series connected between the power busses 84 and 86 with the normally closed contacts 120. When the relay 116 is energized, contacts 120 open to prevent energization of the alarm 122.

In the event that the emergency stop button 110 is depressed, relay 116 is denergized, allowing normally closed contacts 112 to be opened, or if either temperature responsive switch 53 senses a temperature in excess of a predetermined temperature, relay 116 will be denergized. Denergization of relay 116 will effect closing of contacts 120 to energize the alarm 122 and opening of contacts 118 to denergize relay 102 and open contacts C1. While an audible alarm has been disclosed, other types of annunciators could be utilized.

The normally closed contacts 112 are high temperature contacts controlled by the digital temperature controller 92. When the temperature sensor 57 senses a temperature in excess of a predetermined temperature, digital temperature controller 92 will open normally closed contacts 112 to denergize relay 116. Denergization of relay 116 will effect denergization of safety relay 102 and energization of alarm 122. The electrical resistance heaters 22, 24 and 26 will be denergized by the opening of contacts C1 associated with the safety relay 102.

Temperature responsive switches 53 are also series connected with relay 116. The temperature responsive switches 53 provide a further safety control to effect denergization of relay 116 in the event that the temperature sensed by either switch 53 is in excess of a predetermined temperature.

When fluid flow between the inlet 12 and outlet 14 of the tubular chamber 20 ceases, as sensed by the differential pressure switch 60, the differential pressure switch 60 will open to cause the digital temperature controller 92 to denergize heating contactor 104 and open contacts RM1 to denergize the electrical resistance heaters 22, 24 and 26. When pressure switch 60 moves to its open position it energizes timing circuit 100 via lines 126 and 128. The timing circuit 100 effects opening of the normally closed exhaust valve 66 for a predetermined time interval calculated by the timing circuit 100. Opening of valve 66 allows fluid in the tubular chamber 20 to be vented to remove residual heat from resistance heaters 22, 24 and 26. The solenoid exhaust valve 66 remains open for a predetermined period of time to insure that residual heat is removed.

A heater 10 constructed in accordance with the present invention has been tested in an ultrapure application involving the cleansing of etched silicon wafers. The test results indicated that particle contamination on the wafers before and after rinsing the wafers using ultrapure water heated in the present heater 10 had a mean deviation for particle contamination of 0 to 5 particles per wafer, as compared to a mean deviation of approximately 24 to 76 particles per wafer using known commercially available heaters. It was found that the commercially available heaters actually contributed as many as 925 particles to a wafer, whereas when a heater 10 constructed in accordance with the present invention was used, the particle count was reduced by as much as 23 particles per wafer. No contaminating ions were present on the wafers after the wafers had been cleaned using ultrapure water heated by a heater 10 of the present invention.

From the foregoing, it should be apparent that a new and improved tubular high efficiency, non-contaminating fluid heater 10 has been provided which minimizes fluid interstitial matrices and stagnant zones which provide potential contamination sites and which minimizes fluid pressure drop therethrough. The fluid heater includes an elongate tubular member 16 having a coil-like configuration and a substantially cylindrical sidewall 18 which defines an elongate tubular chamber 20 through which fluid is adapted to flow. The tubular member 16 includes an inlet 12 and an outlet 14. A plurality of elongate electrical resistance heaters 22, 24 and 26 are located in the elongate tubular chamber for heating the fluid as it passes through the chamber 20. Each of the resistance heaters has end portions with a streamlined generally arcuate configuration which extends through the sidewall 18 of the tubular members 16. The streamlined generally arcuate configuration of the heater end portions 31 generally eliminates interstitial matrices and stagnant zones in the fluid flow adjacent the ends of the elongate electrical resistance heaters 22, 24 and 26. This construction provides for high velocity turbulent fluid flow through the tubular chamber 20 which brings the fluid to be heated into intimate contact with the electrical resistance heaters and which scavenges the cylindrical sidewall 18 of the tubular member 16, the electrical resistance heaters 22, 24 and 26, and the inlet/outlet (12/14) of the heater to prevent contaminants from accumulating within the fluid heater 10.

What is claimed is:

1. A tubular high efficiency, non-contaminating fluid heater which minimizes fluid pressure drop therethrough and which minimizes fluid interstitial matrices and eliminates fluid stagnant zones which provide potential contamination sites comprising an elongate tubular member having a coil-like configuration and a substantially cylindrical sidewall which defines an elongate tubular chamber through which fluid is adapted to flow, said tubular member including an inlet at one end thereof for receiving fluid to be heated and an outlet at the other end thereof and through which heated fluid is adapted to exit the tubular member, said tubular member being formed from a substantially inert material, a plurality of elongate electrical resistance heaters located in said elongate tubular chamber for heating the fluid as the fluid passes through the tubular chamber, each of said elongate resistance heaters being sheathed in a substantially inert sheath formed from the same substantially inert material as said tubular member, each of said elongate resistance heaters having a coil-like configuration which extends through said elongate tubular chamber and heater end portions at each end thereof, each of said heater end portions having a streamlined generally arcuate configuration substantially parallel to the direction of fluid flow which extends through said sidewall of said tubular member at each end of said elongate electrical resistance heaters, said streamlined generally arcuate configuration of said heater end portions substantially eliminating interstitial matrices in the fluid flow adjacent the ends of said elongate electrical resistance heaters which extend through said sidewall of said tubular member and any stagnant zones and wherein fluid flow from said inlet to said outlet through said tubular chamber is substantially high velocity, turbulent fluid flow having a Reynolds number greater than 4,000 which brings the fluid into intimate contact with said electrical resistance heaters and which scavenges said cylindrical sidewall of said tubular member, said electrical resistance heaters and said inlet and outlet, to prevent contaminates from accumulating within said fluid heater.

2. A tubular high efficiency, non-contaminating fluid heater, as defined in claim 1, further including a differential pressure switch for sensing the difference in fluid pressure between said inlet and said outlet of said fluid chamber, a flow switch for sensing fluid flow through said elongate tubular chamber, said switches being adapted to energize said electrical resistance heaters in response to turbulent fluid flow through said tubular chamber, and wherein said switches are further adapted to sense a predetermined fluid flow rate through said tubular chamber and denergize said electrical resistance heaters in response to said switches sensing said predetermined fluid flow rate which is not turbulent.

3. A tubular high efficiency, non-contaminating fluid heater, as defined in claim 2, further including an exhaust valve in fluid communication with said tubular chamber for exhausting fluid from said tubular chamber in response to said switches sensing said predetermined fluid flow rate which is not turbulent.

4. A tubular high efficiency, non-contaminating fluid heater as defined in claim 3, further including an over-temperature sensor for sensing when the fluid in said tubular chamber reaches a pre-determined value, said over-temperature sensor being adapted to denergize said fluid heater in response to sensing a temperature of said predetermined value in said tubular chamber.

5. A tubular high efficiency, non-contaminating fluid heater which minimizes fluid pressure drop therethrough and which minimizes fluid interstitial matrices and eliminates fluid stagnant zones which provide potential contamination sites comprising an elongate tubular member having a coil-like configuration and a substantially cylindrical sidewall which defines an elongate tubular chamber through which fluid is adapted to flow, said tubular member including an inlet at one end thereof for receiving fluid to be heated and an outlet at the other end thereof and through which heated fluid is adapted to exit the tubular member, a plurality of elongate electrical resistance heaters located in said elongate tubular chamber for heating the fluid as the fluid passes through the tubular chamber, each of said elongate resistance heaters being sheathed in a substantially inert sheath, each of said elongate resistance heaters having a coil-like configuration which extends through said elongate tubular chamber and heater end portions at each end thereof, each of said heater end portions having a streamlined generally arcuate configuration substantially parallel to the direction of fluid flow which extends through said sidewall of said tubular member at each end of said elongate electrical resistance heaters, said streamlined generally arcuate configuration of said heater end portions substantially eliminating interstitial matrices in the fluid flow adjacent the ends of said elongate electrical resistance heaters which extend through said sidewall of said tubular member and any stagnant zones and wherein fluid flow from said inlet to said outlet through said tubular chamber is substantially high velocity, turbulent fluid flow having a Reynolds number greater than 4,000, which brings the fluid into intimate contact with said electrical resistance heaters and which scavenges said cylindrical sidewall of said tubular member, said electrical resistance heaters and said inlet and outlet, to prevent contaminates from accumulating within said fluid heater, a plurality of power conductors, each of which is connected to a different heater end portion of said plurality of electrical resistance heaters, each power conductor being connected to the respective heater end portion adjacent the exterior of said substantially cylindrical sidewall of said tubular member, and further including a sealed chamber disposed adjacent to said exterior of said substantially cylindrical sidewall of said tubular member at each end thereof, said connection of said power conductor to said heater portions at each end of the tubular member being located within said sealed chambers to prevent moisture from contacting said heater end portions, said sealed chambers including electrical insulation means therein to prevent the transfer of electrical power from said connection of said power conductors and said heater end portions externally of said sealed chamber.

6. A tubular high-efficiency, non-contaminating fluid heater, as defined in claim 5, wherein each of said heater end portions extends through an opening in said sidewall of said tubular member; each of said heater end portions being welded to said sidewall of said tubular member adjacent said opening in said sidewall to rigidly secure said heater end portions and to seal said opening in said sidewall; and wherein said heater end portions each includes an epoxy seal therein adjacent to the portion of said heater end portion which is welded to said sidewall of said tubular member for preventing moisture from entering said electrical resistance heaters at said heater end portion.

7. A tubular high efficiency, non-contaminating fluid heater which minimizes fluid pressure drop therethrough and which minimizes fluid interstitial matrices and eliminates stagnant zones which provide potential contamination sites comprising an elongate tubular member having a coil-like configuration and a substantially cylindrical sidewall which defines an elongate tubular chamber through which fluid is adapted to flow, said tubular member including an inlet at one end thereof for receiving fluid to be heated and an outlet at the other end thereof and through which heated fluid is adapted to exit the tubular member, a plurality of elongate electrical resistance heaters located in said elongate tubular chamber for heating the fluid as the fluid passes through the tubular chamber, each of said elongate resistance heaters having a coil-like configuration which extends through said elongate tubular chamber and a heater end portion at one end thereof, each of said heater end portions having a streamlined generally arcuate configuration substantially parallel to the direction of fluid flow which exits through an opening in said sidewall of said tubular member at one end of said elongate electrical resistance heaters, each of said heater end portions being secured to said sidewall of said tubular member adjacent said opening to rigidly secure said heater end portions and to seal said opening in said sidewall, said streamlined generally arcuate configuration of said heater end portions substantially eliminating interstitial matrices and eliminating stagnant zones in the fluid flow adjacent the ends of said elongate electrical resistance heaters which extend through said sidewall of said tubular member, a differential pressure switch for sensing the difference in fluid pressure between said inlet and said outlet for said fluid chamber, and a flow switch for sensing fluid flow through said elongate tubular chamber, said switches being adapted to energize said electrical resistance heaters in response to turbulent fluid flow through said tubular chamber, said switches being further adapted to sense a predetermined fluid flow rate which is not turbulent through said tubular chamber and de-energize said electrical resistance heaters in response to said switches sensing said predetermined fluid flow rate which is not turbulent, and wherein fluid flow from said inlet to said outlet through said tubular chamber is substantially high velocity, turbulent fluid flow having a Reynolds number greater than 4,000 which brings the fluid into intimate contact with said electrical resistance heaters and which scavenges said cylindrical sidewall of said tubular member and said electrical resistance heaters to prevent contaminates from accumulating within said fluid heater.

8. A tubular high-efficiency, non-contaminating fluid heater, as defined in claim 7, further including an exhaust valve in fluid communication with said tubular chamber for exhausting fluid from said tubular chamber when said fluid flow is not turbulent.

9. A tubular high-efficiency, non-contaminating fluid heater, as defined in claim 8, wherein said differential pressure switch energizes said exhaust valve to exhaust fluid from said tubular chamber in response to the differential pressure sensed between said inlet and said outlet of said tubular chamber being indicative of the termination of fluid flow through said tubular chamber.

10. A tubular high efficiency, non-contaminating fluid heater as defined in claim 9, further including an over-temperature sensor for sensing when the fluid in said tubular chamber reaches a pre-determined value, said over-temperature sensor being adapted to denergize said fluid heater in response to sensing a temperature of said predetermined value in said tubular chamber.

11. A tubular high efficiency, non-contaminating fluid heater as defined in claim 10, further including alarm means for establishing an alarm signal when the temperature of said fluid in said tubular chamber reaches said predetermined value, said alarm means being responsive to said over-temperature sensor.

12. A tubular high efficiency, non-contaminating fluid heater as defined in claim 8, further including timer means for energizing said exhaust valve to exhaust fluid from said tubular chamber for a predetermined time period in response to termination of fluid flow in said tubular chamber.

13. A tubular high efficiency, non-contaminating fluid heater which minimizes fluid pressure drop therethrough and which minimizes fluid interstitial matrices and eliminates stagnant zones which provide potential contamination sites comprising an elongate tubular member having a coil-like configuration and a substantially cylindrical sidewall which defines an elongate tubular chamber through which fluid is adapted to flow, said tubular member including an inlet at one end thereof for receiving fluid to be heated and an outlet at the other end thereof and through which heated fluid is adapted to exit the tubular member, a plurality of elongate electrical resistance heaters located in said elongate tubular chamber for heating the fluid as the fluid passes through the tubular chamber, each of said elongate resistance heaters having a coil-like configuration which extends through said elongate tubular chamber and a heater end portion at one end thereof, each of said heater end portions having a streamlined generally arcuate configuration substantially parallel to the direction of fluid flow which extends through an opening in said sidewall of said tubular member at one end of said elongate electrical resistance heaters, each of said heater end portions being secured to said sidewall of said tubular member adjacent said opening to rigidly secure said heater end portion and to seal said opening in said sidewall, said streamlined generally arcuate configuration of said heater end portions substantially eliminating interstitial matrices and eliminating stagnant zones in the fluid flow adjacent the ends of said elongate electrical resistance heaters which extend through said sidewall of said tubular member and wherein fluid flow from said inlet to said outlet through said tubular chamber is substantially high velocity, turbulent fluid flow which brings the fluid into intimate contact with said cylindrical resistance heaters and which scavenges said cylindrical sidewall of said tubular member and said electrical resistance heaters to prevent contaminates from accumulating within said fluid heater, further including a plurality of power conductors, each of which is connected to said heater end portion of different ones of said plurality of electrical resistance heaters, said power conductors being connected to said heater end portions adjacent the exterior of said substantially cylindrical sidewall of said tubular member, and a sealed chamber disposed adjacent to said exterior of said substantially cylindrical sidewall of said tubular member, said connection of said power conductors at one end thereof to said heater end portions being located within said sealed chamber to prevent moisture from contacting said heater end portions, said sealed chamber including electrical insulation means therein to prevent the transfer of electrical power from said connection of said power conductors and said heater end portions externally of said sealed chamber.

14. A tubular high-efficiency, non-contaminating fluid heater, as defined in claim 13, wherein said heater end portions include an epoxy seal therein adjacent to the portion of said heater end portion which is welded to said sidewall of said tubular member for preventing moisture from entering said electrical resistance heaters at said heater end portions.

* * * * *